US005078389A

United States Patent [19]

Chen

[11] Patent Number: 5,078,389

[45] Date of Patent: Jan. 7, 1992

[54] EXERCISE MACHINE WITH THREE EXERCISE MODES

[76] Inventor: David Chen, No. 219, Shui Mei Road, Wai Puttsiang, Taichung, Taiwan

[21] Appl. No.: 733,110

[22] Filed: Jul. 19, 1991

[51] Int. Cl.[5] ..... A63B 69/18; A63B 23/04

[52] U.S. Cl. ..... 272/70; 272/97; 272/146

[58] Field of Search ..... 272/70, 69, 72, 73, 272/93, 97, 146, 96

[56] References Cited

U.S. PATENT DOCUMENTS 3,834,693 9/1974 Poppenberger ..... 272/97
4,391,441 5/1983 Simjian ..... 272/146
4,838,543 6/1989 Armstrong et al. ..... 272/70

*Primary Examiner*—Stephen R. Crow

[57] ABSTRACT

An exercise machine comprising an elongate slide platform with a mount slidingly secured thereon, a footrest rotatably secured to the top of the mount, a base bar with one end thereof secured to the slide platform under the central portion thereof, a vertical post with the lower end thereof secured to the opposite end of the base bar, a pair of foldable pedal bars pivotably secured to respective lateral sides of the vertical post near the lower end thereof, and a pair of handles extending from respective lateral sides of the vertical post near the upper end thereof. The mount and the pedal bars are connected with resistance elements that resist the respective sliding and pivoting motions thereof. Resistance elements also resist the rotational motion of the footrest. Whereby, with hands gripping the handle bars and feet resting on the footrest a user can exercise various parts of his or her body by sliding the footrest to and fro along the platform or rotating the footrest in opposite directions about the mount, or with feet on the pedals, by pedaling up and down in stairclimbing fashion.

11 Claims, 10 Drawing Sheets

EXERCISE MACHINE WITH THREE EXERCISE MODES

BACKGROUND OF THE PRESENT INVENTION

The present invention relates to a floor mounted exercise machine, and more particularly to a floor mounted exercise machine which provides three modes of exercise motions that exercise various parts of a user's body, and in particular the waist, legs, and muscles controlling lateral motions of the body.

Though exercise machines, such as rowing machines, cycling machines, and tread mills, are known from the prior art, most restrict a user to a single exercise motion that, though sufficiently exercising certain muscle groups and body parts, leaves other muscle groups and body parts neglected. Moreover, a single exercise motion tends to be montonous and stresses specific muscle groups within the body without a rest period provided by an alternate exercise motion.

The exercise machine of the present invention, however, provides three independent exercise motions that together offers a well rounded exercise to a user's body. A user can select an alternate exercise mode to give rest to the muscle groups and body parts exercised in another exercise mode.

In a first exercise mode, a user grasps a pair of forwardly disposed handle bars and stands in a largely erect position with feet resting against a footrest, provided on the exercise machine of the present invention. The user then repeatedly slides the footrest to and fro along a slide platform engaged therewith with lateral motions of his or her torso and legs.

With the footrest rotatably secured in a central position along the slide platform, a user could also repeatedly rotate the footrest first in one direction and then the other with twisting motions of his or her waist and legs, in a second exercise mode.

In a third exercise mode a user grasps the pair of handle bars and repeatedly steps down on a pair of pedal bars, provided on the exercise machine forward of the slide platform, in an alternating fashion, to simulate a stair climbing motion.

Though the exercise machine of the present invention is mainly suited for exercising the waist, legs, and muscles controlling lateral motions of the torso, the arms and shoulders also come into play as they must counter the reaction force from the lower parts of the body.

The first mode of exercise would be particularly well suited for skiers as it simulates the swaying motions which are a marked feature of their sport.

The second mode of exercise is an efficient means of trimming adipose tissue from the waist and legs for the obese, while the third mode of exercise is suited for runners and the like who need speed in their legs.

In particular, football players are often seen performing stair climbing exercises which is closely simulated by the third exercise motion.

Overall, the exercise machine of the present invention provides a thorough form of general exercise suitable for an average physical fitness enthusiast or a serious athlete.

SUMMARY OF THE PRESENT INVENTION

The exercise machine of the present invention has a first objective of providing an exercise machine that includes a footrest slidingly attached to an elongate slide platform aligned in a generally lateral direction with respect to a user's body, and that enables a user to exercise various parts of his or her body by grasping a pair of fixed handle bars and repeatedly sliding the footrest with his or her feet to and fro along the slide platform. A second objective of the exercise machine of the present invention is to provide an exercise machine that includes a footrest that is rotatably secured to a fixed member of the exercise machine, and that enables a user to exercise various parts of his or her body by grasping the fixed handle bars and repeatedly rotating the footrest with his or her feet first in one direction and then in the other direction. A third objective of the exercise machine of the present invention is to provide an exercise machine that includes a pair of pedal bars, each pivotably secured on one end thereof to a fixed member of the exercise machine, and that enables a user to exercise various parts of his or her body by grasping the fixed pair of handle bars and alternately stepping down on each pedal bar in a stair climbing fashion.

The exercise machine of the present invention comprises an elongate slide platform with a mount slidingly secured thereon, a circular footrest rotatably secured to the top of the mount, a base bar with one end thereof secured to the slide platform under the central portion thereof, a vertical post disposed forward of the slide platform with the lower end thereof secured to the opposite end of the base bar, a pair of foldable pedal bars pivotably secured to respective lateral sides of the vertical post on the lower portion thereof, and a pair of handle bars extending from respective lateral sides of the vertical post near the upper end thereof.

The elongate slide platform has a pair of recessed tracks formed along respective longitudinal sides thereof. A longitudinal slot is formed along the upper side of the slide platform in a central position thereon.

The mount is roughly bracket shaped having an approximately square top side with rectangular front and rear sides adjoining therewith at right angles along respective front and rear edges thereof.

A first pair of rollers are disposed behind the front side of the mount near respective lateral edges thereof and are rotatably secured to respective axle pins secured thereon. Likewise, a second pair of rollers are disposed behind the rear side of the mount near respective lateral edges thereof and are rotatably secured to respective axle pins secured thereon.

The mount is disposed over the slide platform with the top side thereof separated from the upper side of the slide platform by a small space, and with the first and second pairs of rollers therein resting within respective recessed tracks on the front and rear longitudinal sides of the slide platform.

The mount is thus slidingly secured to the slide platform.

A circular hole is formed on the center of the top side of the mount with a journal sleeve secured therein.

The circular footrest has an axle projection formed on the center of the lower side thereof, and is disposed over the mount with the axle projection inserted into the journal sleeve and forming a snug fit therein to rotatably attach the footrest thereon.

The base bar is aligned with the center of the slide platform and is perpendicular with the longitudinal axis thereof.

Motion of the mount and attached footrest away from the center of the slide platform is resisted in a pre-determined manner by a first resistance mechanism.

The first resistance mechanism comprises a telescoping elastic member which includes a first tubular element inserted over and slidingly engaged with a second tubular element of smaller diameter, and a spring element disposed within the tubular elements.

One end of the first tubular element is pivotably secured to to the upper side of the base bar near the end thereof to which the vertical post is secured.

The opposite end of the second tubular element is pivotably secured to a lug provided on the center of the front side of the mount.

One end of the spring element is secured to the position of the pivoted end of the first tubular element and the other end thereof is secured to the position of the pivoted end of the second tubular element.

When the mount is moved away from the center of the slide platform, the telescoping elastic member pivots laterally and telescopes outward with the spring element therein being elongated and exerting a resistance force.

A user, with hands firmly grasping respective handle bars and standing in a largely erect position with feet resting against the footrest, can repeatedly move the footrest and mount to and fro along the slide platform with lateral motions of his or her legs and torso.

The first objective of the present invention is thereby achieved.

A through hole is formed on the center of the rear side of the mount and on center of the track on the rear longitudinal side of the slide platform.

The mount can be slid along the slide platform to align the through hole on the rear side of the mount with the through hole on the rear track of the slide platform.

A securing pin with an eyelet formed on one end thereof can be inserted through the aligned through holes to secure the mount in a central position on the slide platform.

With the mount so secured on the slide platform, a user, with hands firmly grasping respective handle bars and standing in a largely erect position with feet resting against the footrest, can repeatedly rotate the footrest about the mount first in one direction and then in the other direction with twisting motions of his or her waist and legs.

The second objective of the present invention is thus also achieved.

Each foldable pedal bar includes a pivoting section and a folding section with comparable lengths. The rear end of each pivoting section is pivotably secured along a vertical plane to respective lateral sides of the vertical post at pre-determined positions on the lower portion thereof, so as to enable the pedal bars to be pivoted upwards and downwards.

The rear end of each folding section is pivotably secured in clevis joint fashion to the front portion of a respective pivoting section.

The folding sections of the pedal bars, when not in use, are normally folded rearwards to a stop position with each folding section assuming an acute angle with respect to a corresponding pivoting section.

When in use, the folding sections of the respective pedal bars are pivoted forward until the sloped rear sides thereof abut the sloped front sides of the respective pivoting sections, each folding section is then aligned with a respective pivoting section.

The front portions of each folding section are then positioned over the central portion of the slide platform and separated therefrom by a substantial distance.

Pivoting motion of the pair of brake pedals is resisted in a pre-determined manner by a second resistance mechanism including a viscous sliding brake member disposed within the base bar.

The viscous sliding brake member includes a cylindrical brake element slidingly secured on a central rod passing concentrically therethrough and is both mechanically and viscously coupled therewith. The brake element exerts a resisting counter force when slid in either direction along the central rod.

Respective ends of the central rod are secured to fixed positions within the base bar in proximity to respective ends thereof.

A pair of protruding lugs are formed on respective ends of the brake element and protrude laterally outwards from under respective lateral sides of the base bar.

The pair of pivoting pedal bars are engaged with the brake cylinder through a first and second cables as described below.

The first cable is secured on one end thereof to a lug protruding from the inner lateral side of the pivoting section of a first pedal bar near the front end thereof, and the second cable is secured on one end thereof to a lug protruding from the inner lateral side of the pivoting section of a second pedal bar near the front end thereof.

A first pair of pulleys are rotatably secured to respective lateral sides of the vertical post at pre-determined positions thereon above the positions of the rear ends of the pivoting sections of the pedal bars.

A second pair of pulleys are rotatably secured to respective lateral sides of the vertical post at pre-determined positions thereon in proximity to the lower end thereof and below the positions of the rear ends of the pivoting sections of the pedal bars.

Another pulley is rotatably secured to a corresponding lateral side of the base bar at a predetermined position thereon between the rear end thereof and the rear end of the brake cylinder of the viscous sliding brake.

The first and second cables extend upwards and rearwards from the respective pedal bars attached therewith to pass around corresponding pulleys of the first pair and descend toward and pass around corresponding pulleys of the second pair.

The first cable then extends towards the rear of the base bar and passes around the pulley disposed thereon with the other end thereof secured to a corresponding protruding lug of the brake element.

The second cable also extends towards the rear of the base bar and secures to the other protruding lug of the brake element.

Thus, when one of the pedal bars pivots downward the brake element is drawn towards a corresponding end of the central rod by the corresponding cable attached therebetween. The other pedal bar concomitantly pivots upward, being drawn by the other cable which is pulled along by the brake cylinder.

To perform exercises on the pedal bars, a user would first remove the footrest from the mount and unfold the pedal bars as described above. Then, with hands firmly grasping respective handle bars, a user would alternately and repeatedly step down first on one pedal bar and then the other, simulating a stair climbing motion.

The third objective of the present invention is thereby also achieved.

A detailed description of the structure and other features of the exercise machine of the present invention along with accompanying drawings are provided below.

A BRIEF DESCRIPTION OF THE DRAWINGS

PREFERRED EMBODIMENT OF THE PRESENT INVENTION

Figure 1:
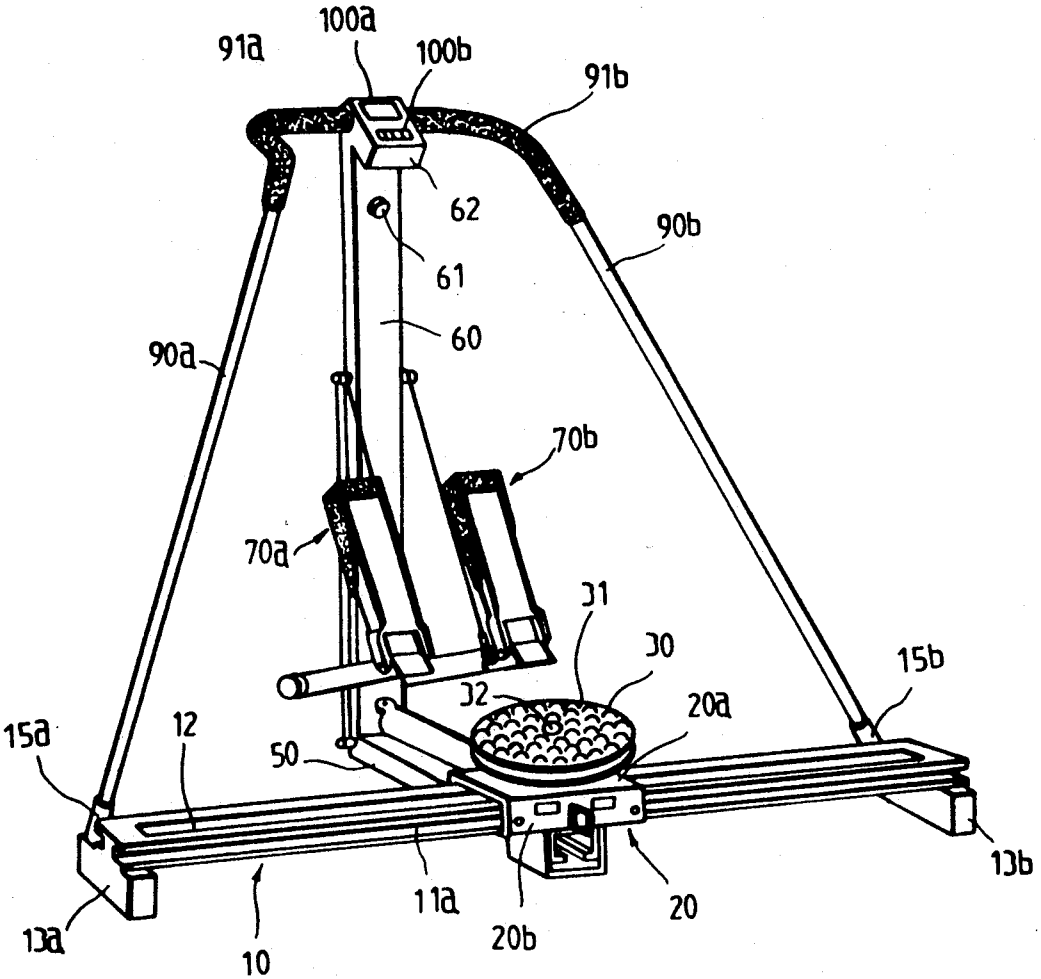
FIG. 1 is a perspective view of an embodiment of the exercise machine of the present invention.

Referring to FIG. 1, the exercise machine of the present invention comprises an elongate slide platform 10 with a mount 20 slidingly secured thereon, a disk shaped footrest 30 rotatably secured to the top of mount 20, a base bar 50 with one end thereof secured to slide platform 10 under the central portion thereof, a vertical post 60 disposed forward of slide platform 10 with the lower end thereof secured to the opposite end of base bar 50, a pair of foldable pedal bars, 70*a* and 70*b*, pivotably secured to respective lateral sides of vertical post 60 on the lower portion thereof, and a pair of handle bars, 90*a* and 90*b*, extending from respective lateral sides of vertical post 60 near the upper end thereof.

Figure 2:
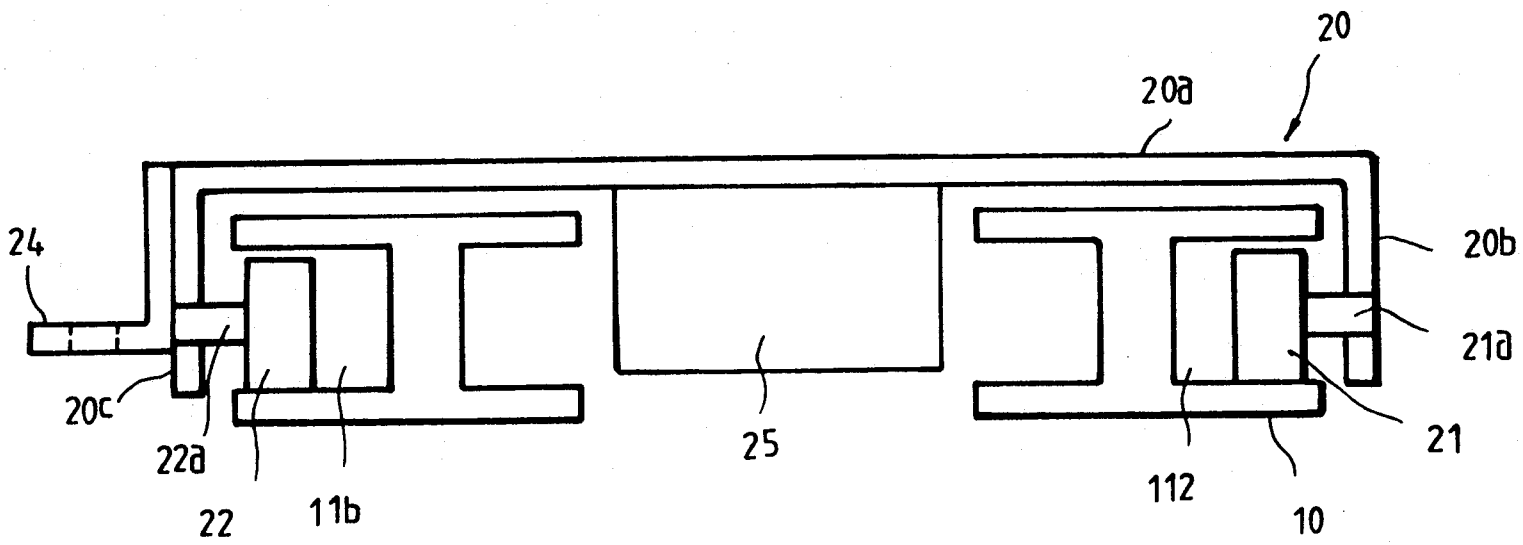
FIG. 2 is a side view of a slide platform and a mount slidingly secured thereon, of an embodiment of the exercise machine of the present invention.
Figure 3:
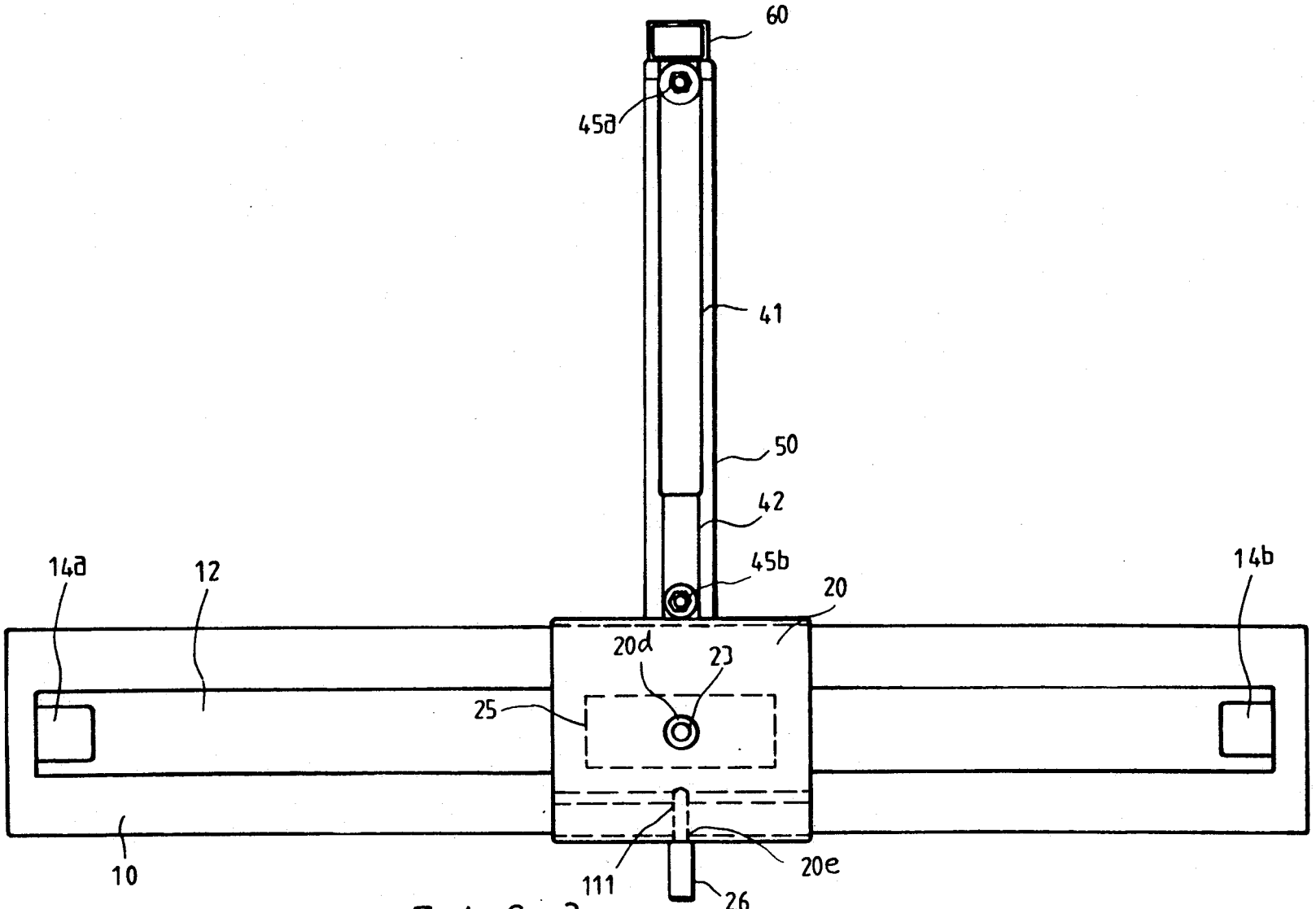
FIG. 3 is a top view of a slide platform, a mount slidingly secured thereon, and a telescoping elastic member with respective ends thereof pivotably secured to the mount and a base bar, of an embodiment of the exercise machine of the present invention.
Figure 4:
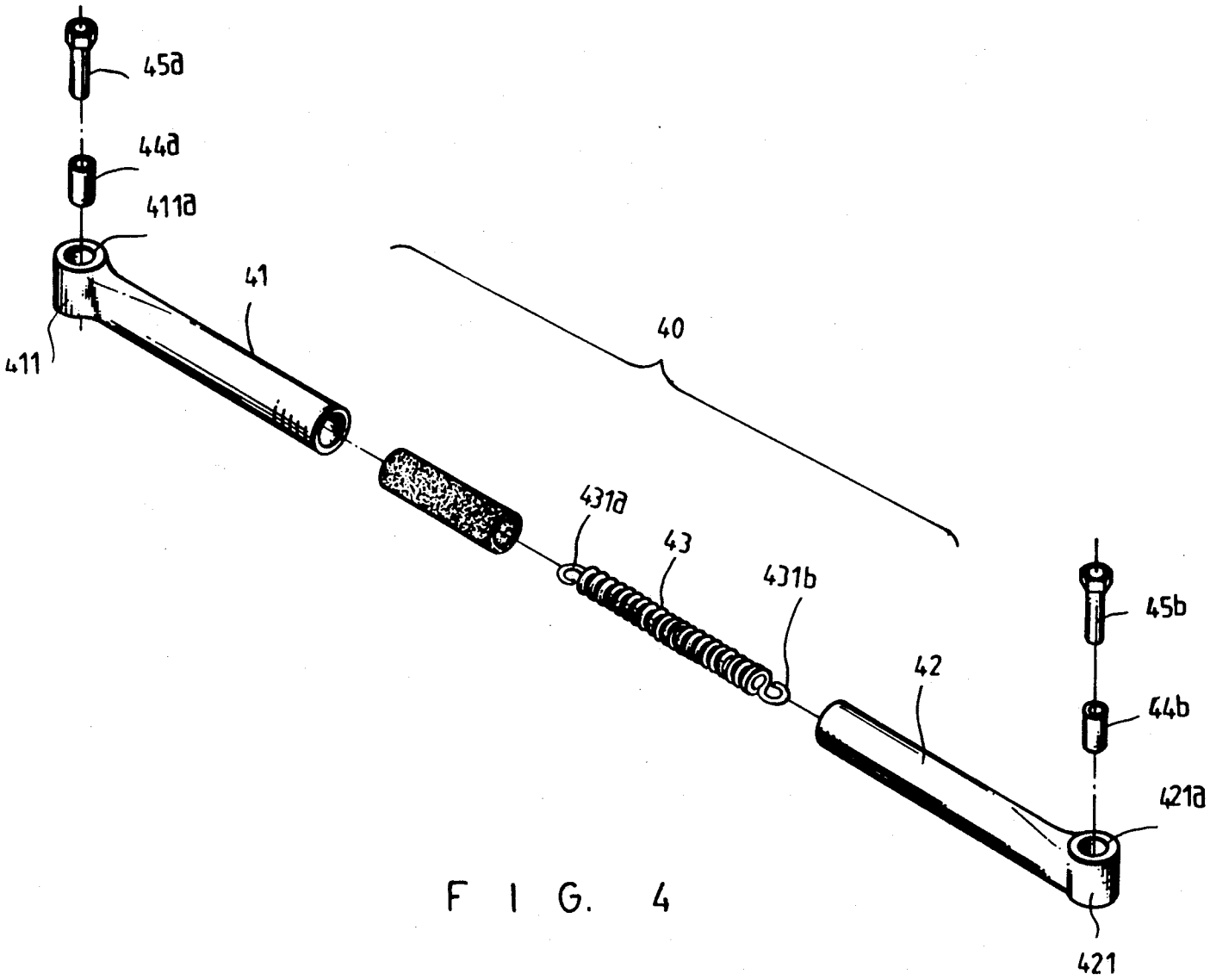
FIG. 4 is a perspective exploded view of a telescoping elastic member of an embodiment of the exercise machine of the present invention.

Referring to FIGS. 1 and 2, elongate slide platform 10 has a pair of recessed tracks. 11*a* and 11*b*, formed along respective front and rear longitudinal sides thereof. A longitudinal slot 12, shown also in FIG. 3, is formed along the upper side of slide platform 10 in a central position thereon.

A pair of support blocks, 13*a* and 13*b*, are secured to the lower side of slide platform 10, adjacent to the respective lateral ends thereof, raising slide platform above the floor and defining a space therebetween.

Mount 20, with a generally bracket shaped side profile, has an approximately square top side 20*a* with rectangular front and rear sides 20*b* and 20*c* adjoining therewith at right angles along respective front and rear edges thereof.

A first pair of rollers 21 are disposed behind front side 20*b* of mount 20 near respective lateral edges thereof and are rotatably secured to respective axle pins 21*a* secured thereon at corresponding positions. Likewise, a second pair of rollers 22 are disposed behind rear side 20*c* of mount 20 near respective lateral edges thereof and are rotatably secured to respective axle pins 22*a* secured at corresponding positions thereon.

Mount 20 is disposed over slide platform 10 with top side 20*a* thereof separated from the upper side of slide platform 10 by a small space and with the first and second pair of rollers, 21 and 22, therein resting within respective recessed tracks, 11*a* and 11*b*, of slide platform 10.

Mount 20 is thus slidingly secured to slide platform 10.

A circular hole 20*d* is formed on the center of top side 20*a* of mount 20 with a journal bearing 23 rotatably secured therein.

Disk shaped footrest 30 is made from an elastic synthetic material and has a lumpy top surface 31 with a plurality of rounded protrusions formed thereon which insures ample traction for a user's feet and provides a massaging effect when exercises are performed therewith.

A cylindrical axle projection (not shown) is formed on the center of the lower side of disk shaped footrest 30. The axle projection is manually inserted into journal bearing 23 with a light pressure on footrest 30, forming a friction fit therein to rotatably attach footrest 30 on mount 20.

A central hole 32 is formed on the center of footrest 30 and extends concentrically through the axle projection thereof.

Base bar 50 rests against the floor with one end thereof passing under the central portion of slide platform 10 and securing to the lower side thereof, and is perpendicular with the longitudinal axis of slide platform 10.

Motion of mount 20 and attached footrest 30 away from the center of slide platform 10 is resisted in a predetermined manner by a first resistance mechanism.

Referring to FIGS. 1 to 4, the first resistance mechanism comprises a telescoping elastic member 40 which includes a first tube 41, a second tube 42, and a coil extension spring 43.

First tube 41 has an internal diameter substantially equal with the external diameter of second tube 42, and is inserted over and slidingly engaged thereon.

Both first tube 41 and second tube 42 have a respective barrel shaped securing end, 411 and 421, formed on respective opposing ends thereof.

A pair of pivot holes, 411*a* and 421*a*, are formed in respective securing ends, 411 and 421, and are perpendicularly aligned with the longitudinal axis of telescoping elastic member 40. Each pivot hole, 411*a* and 421*a*, are in communication with the hollow cylindrical interiors of respective first and second tubes, 41 and 42.

A pair of journal sleeves, 44*a* and 44*b*, are disposed within respective pivot holes, 411*a* and 421*a*.

Spring 43 is disposed within first and second tubes, 41 and 42, with the hooked connecting ends, 431*a* and 431*b*, thereof attached to respective journal sleeves, 44*a* and 44*b*, within respective pivot holes, 411*a* and 421*a*.

Pivot holes, 411*a* and 421*a*, are counter-bored on the central portions therein so that respective connecting ends, 431*a* and 431*b*, of spring 43 are separated therefrom by a space and do not come in contact.

Securing end 411 of first tube 41 is pivotably secured to the upper side of base bar 50 near the end thereof on which vertical post 60 is secured, by a bolt 45*a* passing through journal sleeve 44*a* therein and fastened to the upper side of base bar 50.

Securing end 421 of second tube 42 is pivotably secured to a projecting lug 24 secured to the center of front side 20*b* of mount 20, by a bolt 45*b* passing through journal sleeve 44*b* therein and fastened to lug 24.

Figure 5:
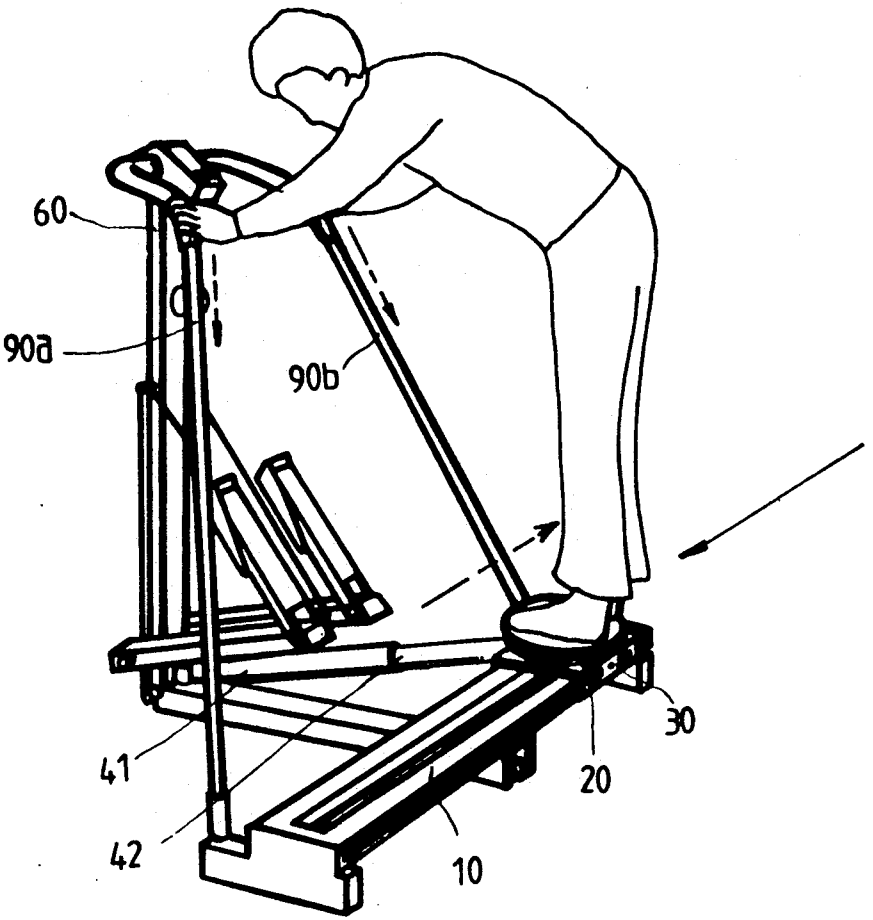
FIG. 5 is a perspective view depicting a user performing exercises on an embodiment of the exercise machine of the present invention by grasping a pair of fixed handle bars thereon and repeatedly sliding a footrest thereon with his or her feet to and fro along the slide platform.

Referring to FIG. 5, when mount 20 is moved away from the center of slide platform 10, telescoping elastic member 40 pivots laterally and telescopes outward with second tube 42 sliding outward from first tube 41 and spring 43 therein being elongated and exerting a resistance force.

A user, with hands firmly grasping respective handle bars, 90*a* and 90*b*, and standing in a largely erect position with feet resting against footrest 30, can repeatedly move footrest 30 and mount 20 to and fro along slide platform 10 with lateral motions of his or her legs and torso. Telescoping elastic member 40 provides resistance to the exercise motion in a pre-determined manner.

A pair of elongate elastic bumper blocks, 14*a* and 14*b*, are disposed within longitudinal slot 12 at respective lateral ends thereof.

A rectangular stop piece 25 is secured to mount 20 under the central portion of top side 20*a* thereof and extends into longitudinal slot 12.

When mount 20 is slid towards an end of slide platform 10, stop piece 25 abuts a corresponding bumper block, 14*a* or 14*b*, which elastically deforms and prevents further motion of mount 20 along the traveled direction.

The deformation of bumper block, 14*a* or 14*b*, eliminates the disturbing shock and noise that would be created if mount 20 were to directly impact slide platform 10.

Referring to FIG. 3, a through hole 20*e* is formed on the center of rear side 20*c* of mount 20, and a similar through hole 111 is formed on the center of the inner wall of longitudinal track 11*b*, on the rear of slide platform 10. Through hole 20*e* can be aligned with through hole 111 by sliding mount 20 to a central position along slide platform 10.

A removable pin 26, as shown in FIG. 1, with an eyelet formed on the outer end thereof can then be inserted through through hole 20*e* and through hole 111, releasably securing mount 20 in a central position on slide platform 10.

Figure 6:
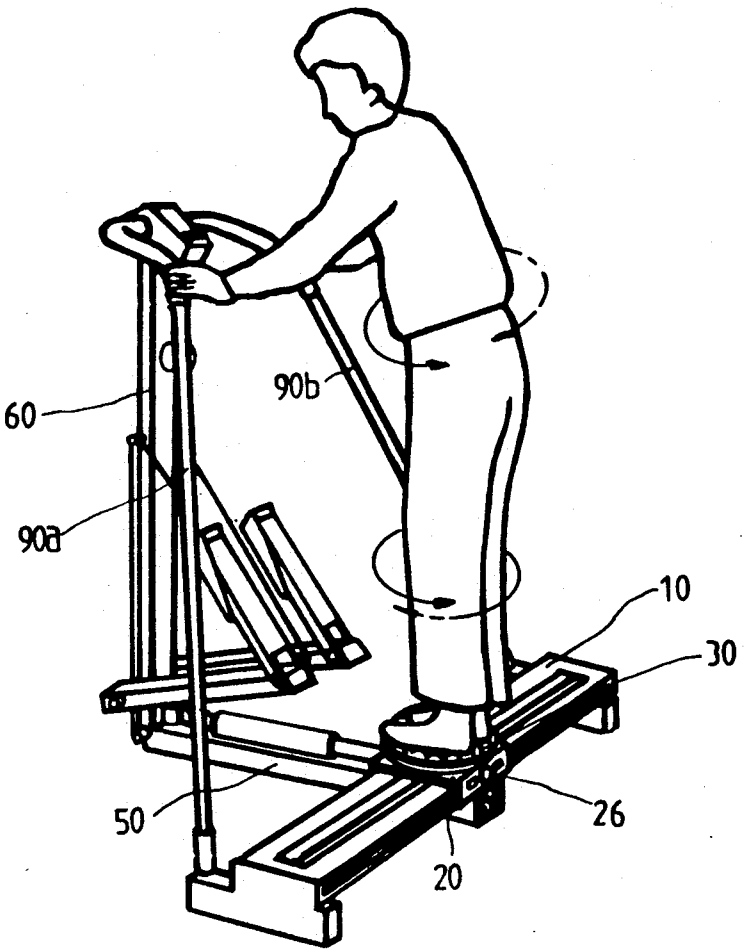
FIG. 6 is a perspective view depicting a user performing exercises on the exercise machine of the present invention by grasping a pair of handle bars thereon and repeatedly rotating a footrest thereon first in one direction and then in the other direction with twisting motions of his or her waist an legs.

Referring to FIG. 6, with mount 20 so secured on slide platform 10, a user, with hands firmly grasping respective handle bars, 90*a* and 90*b*, and standing in a largely erect position with feet resting against footrest 30, can repeatedly rotate footrest 30 about mount 20 first in one direction and then in the other direction with twisting motions of his or her waist and legs.

Figure 7:
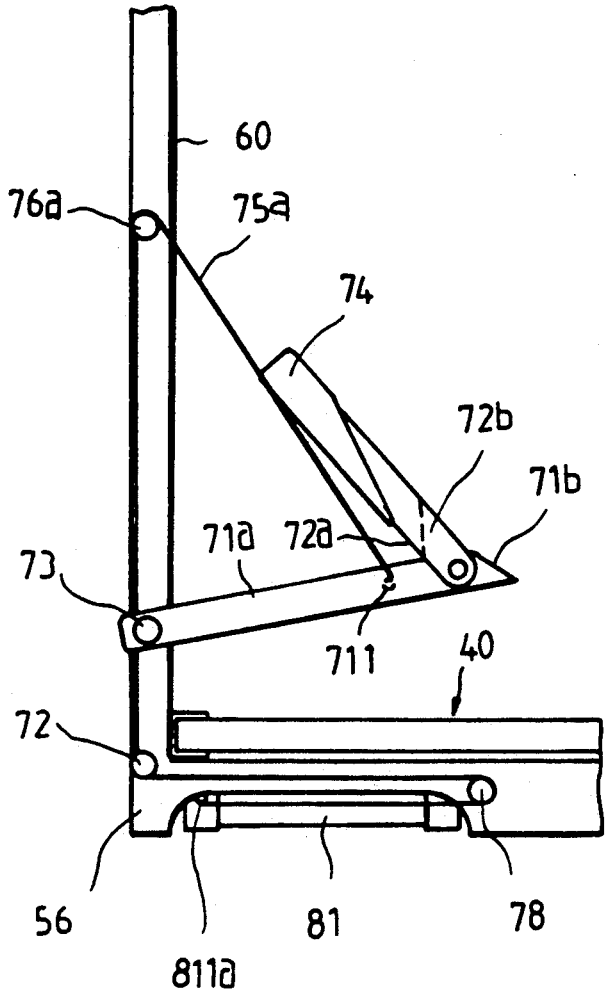
FIG. 7 is a side view of a foldable pedal bar, vertical post, and a base bar with a viscous sliding brake member disposed therein, of an embodiment of the exercise machine of the present invention, taken along a first lateral side thereof.
Figure 8:
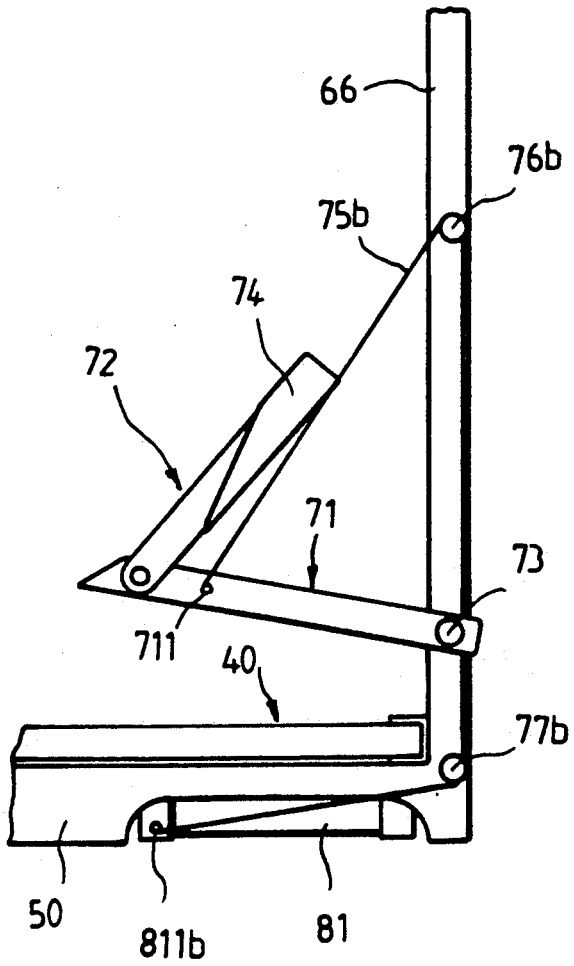
FIG. 8 is a side view of a foldable pedal bar, vertical post, and a base bar with a viscous sliding brake member disposed therein, of an embodiment of the exercise machine of the present invention, taken along a second lateral side thereof.

Referring to FIGS. 1,7, and 8, each foldable pedal bar, 70*a* and 70*b*, includes a pivoting section 71 and a folding section 72 with comparable lengths.

The rear end of each pivoting section 71 is pivotably secured along a vertical plane to respective lateral sides of vertical post 60 at pre-determined positions on the lower portion thereof, by a common axle rod 73 passing therethrough so as to enable pedal bars, 70*a* and 70*b*, to be pivoted upwards and downwards.

The height of axle rod 73 relative to the floor is slightly greater than that of top side 20*a* of mount 20.

The rear end of each folding section 72 is pivotably secured in clevis joint fashion to the front portion of a respective pivoting section 71, by a pair of prongs 721 provided on the rear end of each folding section 72 pivotably secured to respective lateral sides of a corresponding pivoting section 71, on the front portion thereof.

A cover 74, made from a pliant, elastic material, is disposed on the upper side 72*a* of each folding section 72 and serves to provide a comfortable surface for a user's feet and maintains a sufficient traction therewith.

The folding sections 72 of respective pedal bars, 70*a* and 70*b*, when not in use, are normally folded rearwards until the rear edge of upper side 72*a* of each folding section 72 contacts the upper side 71*a* of a respective pivoting section 71. The folding sections 72 then rest at an acute angle with respect to corresponding pivot sections 71.

When in use, folding sections 72 of respective pedal bars, 70*a* and 70*b*, are pivoted forward until the sloped rear sides 72*b* thereof abut the sloped front sides 71*b* of respective pivoting sections 71, each folding section 72 is then aligned with a respective pivoting section 71.

The front portions of each folding section 72 are then positioned over the central portion of slide platform 10 and separated therefrom by a substantial distance.

The pivoting motions of the pair of brake pedals, 70*a* and 70*b*, are coupled in an opposing fashion, with one pedal bar pivoting through a commensurate angle in one direction as the other pedal bar pivots in the other direction, and resisted in a pre-determined manner by a second resistance mechanism.

The second resistance mechanism includes a viscous sliding brake 80 disposed within base bar 50 and engaged with pedal bars, 70*a* and 70*b*, through a first and second cables, 75*a* and 75*b*, of pre-determined lengths.

Figure 9:
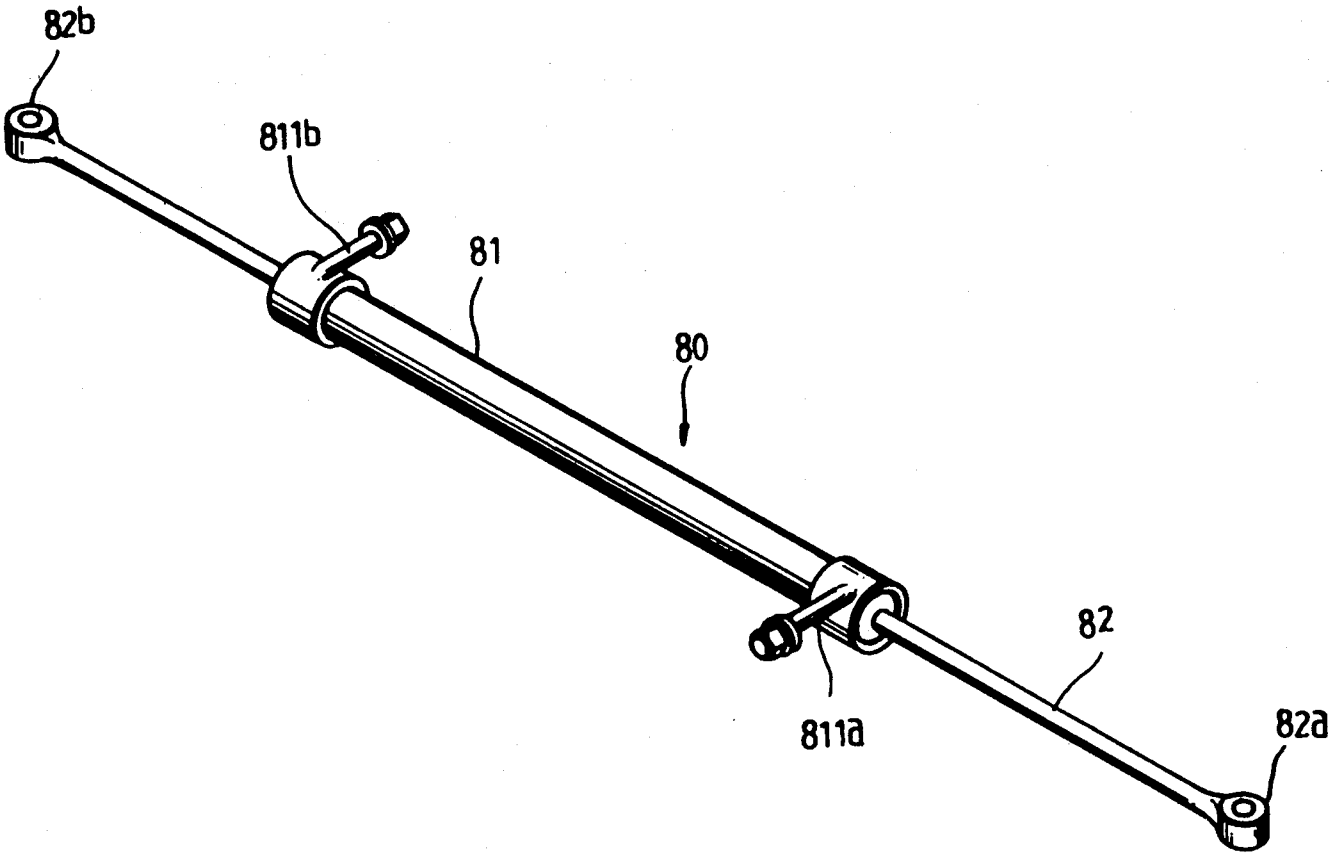
FIG. 9 is a perspective view of a viscous sliding brake member of an embodiment of the exercise machine of the present invention.

Referring to FIG. 9, viscous sliding brake 80 includes a brake cylinder 81 slidingly secured on a central rod 82 passing concentrically therethrough.

The securing ends, 82*a* and 82*b*, of central rod 82 are rigidly secured to fixed positions within base bar 50 in proximity to respective ends thereof by a pair of securing bolts (not shown).

A pair of protruding lugs, 811*a* and 811*b*, are formed on respective ends of brake cylinder 81 and protrude laterally outward from under a raised portion of respective lateral sides of base bar 50, as shown in FIGS. 7 and 8.

Brake cylinder 81 is both mechanically and viscously coupled with central rod 82 by mechanical and fluidic components contained therein, and exerts a resisting counter-force when slided in either direction along central rod 82.

Mechanical components enclosed within brake cylinder 81 also define forward and rearward slide limits thereof at pre-determined positions on central rod 82.

Referring to FIGS. 7 and 8, a first end of cable 75*a* is secured to a lug 711 protruding from the inner lateral side of pivoting section 71 of left pedal bar 70*a* near the front end thereof, and a first end of cable 75*b* is secured to a lug 711 protruding from the inner lateral side of pivoting section 71 of right pedal bar 70*b* near the front end thereof.

A first pair of aligned pulleys, 76*a* and 76*b*, are rotatably secured to respective left and right lateral sides of vertical post 60 at pre-determined positions thereon above the position of axle rod 73.

A second pair of aligned pulleys, 77*a* and 77*b*, are rotatably secured to respective left and right lateral sides of vertical post 60 at pre-determined positions thereon below the position of axle rod 73.

A pulley 78 is rotatably secured to the left lateral side of base bar 50 at a pre-determined position thereon between the rear end thereof and the rear protruding lug 811*a* of brake cylinder 81.

Cables, 75*a* and 75*b*, extend upwards and rearwards from respective pedal bars, 70*a* and 70*b*, attached therewith to pass around respective pulleys, 76*a* and 76*b*, and descend toward and pass around respective pulleys, 77*a* and 77*b*.

Cable 75*a* then extends towards the rear of base bar 50 and passes around pulley 78 disposed thereon with the second end thereof secured to rear protruding lug 811*a* of brake cylinder 81.

Thus, when one of the pedal bars, 70*a* and 70*b*, is pushed downwards by a user's foot, brake cylinder 81 is drawn towards a corresponding end of central rod 82 by the corresponding cable, 75*a* or 75*b*, attached therebetween. The other pedal bar concomitantly pivots upward, being drawn by the other cable which is pulled along by brake cylinder 81.

Pedal bars, 70*a* and 70*b*, have equal upper and lower pivoting limits defined by the forward and rearward slide limits of brake cylinder 81 on central rod 82, with both pedal bars, 70*a* and 70*b*, being substantially parallel with a horizontal plane at the lower pivoting limits thereof.

Figure 10:
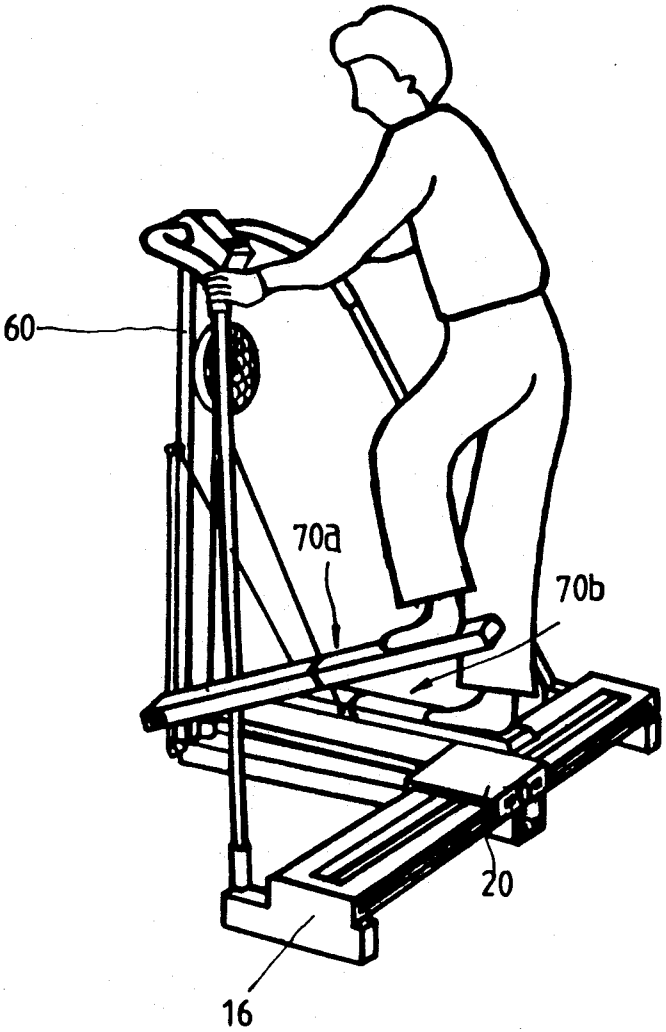
FIG. 10 is a perspective view depicting a user performing exercises on an embodiment of the exercise machine of the present invention by grasping a pair of handle bars thereon and alternately and repeatedly stepping down first on one pedal thereon and then on the other pedal bar thereon in stair climbing fashion.

Referring to FIG. 10, to perform pedaling exercises on the exercise machine of the present invention, a user would first remove footrest 30 from mount 20 and unfold pedal bars, 70*a* and 70*b*, as described above. Then, with hands firmly grasping respective handle bars, 90*a* and 90*b*, a user would repeatedly step down on pedal bars, 70*a* and 70*b*, in an alternating manner, simulating a stair climbing motion.

A protruding socket 61, as shown in FIG. 1, is provided on the front side of vertical post 60, on which footrest 30 can be attached by inserting central hole 32 thereover when removed from mount 20.

The upper portions of handle bars, 90*a* and 90*b*, extend laterally outwards from respective lateral sides of vertical post 60 and bend rearwards and downwards through a curved section thereof, after which handle bars, 90*a* and 90*b*, extend linearly towards a respective pair of ferrules, 15*a* and 15*b*, formed on the front side of respective support blocks, 13*a* and 13*b*, with the lower ends secured therein.

The upper portions of handle bars, 90*a* and 90*b*, are sheathed with a pliant, tactile material forming a respective pair of hand grips, 91*a* and 91*b*, thereon.

An electronic cycle and rate measuring system is provided within a box shaped console 62 formed on the upper end of vertical stem 60 that measures the rate and number of repetitions of a user's exercise motions in any of the three exercise modes described above.

A microprocessor based controller is disposed within console 62 that recieves signals from a set of electronic position sensors, such as limit switches, disposed at appropriate positions within slide platform 10, mount 20, and base bar 50 that relate to the positions of moving members of the exercise machine in corresponding exercise modes.

An electronic display, such as an LCD 100*a*, is visibly disposed within the front face of console 62 and is controlled by the microprocessor based controller. Information relating to the exercise motions such as the rate and number of repetitions are indicated by LCD 100*a*.

A set of control switches 100*b* accessibly disposed on the front face of console 62 below LCD 100*a* control the various functions of the controller.

Other functions, such as storage of measured rate and number of repetitions in a given exercise mode, for latter feference can also be provided.

Such an electronic cycle and rate measuring system can be readily designed and constructed by one skilled in the art and no further specificities need be described herein.

In addition to the first and second resistance mechanisms described a third resistance mechanism comprising a torsion spring can be disposed between footrest 30 and mount 20 and engaged therebetween, so as to resist the rotary motion of footrest 30 in the exercise mode wherein a user rotates footrest 30 with his or her feet first in one direction and then the other, in a pre-determined manner.

Though in the description above many specificities were recited, these should not be interpreted as limitations on the scope of the present invention but merely as one possible mode of realization of a preferred embodiment thereof.

Many variations and modifications of the exercise machine of the present invention are possible and would be readily apparent to one skilled in the art. In particular, the first, second, and third resistance mechanisms can be implemented with various techniques and positioned about various fixed members of the exercise machine.

Further, the resistance members thereof can include both mechanical and viscous resistance elements to suitably define the resistance to the corresponding exercise motions.

As such, the spirit and scope of the exercise machine of the present invention should not be defined by the exposition above but by the appended claims.

I claim:

1. A floor mounted exercise machine comprising:

an elongate slide platform;

a mount slidingly secured to said slide platform;

a footrest rotatably secured to said slide platform;

a base bar with one end thereof secured to the central portion of said slide platform;

a pair of pedal bars, with one end of each said pedal bar pivotably secured to a respective lateral side of a vertical post on a lower portion thereof and the other end of each said pedal bars extended towards said slide platform;

a pair of handle bars extending outwardly from respective lateral sides of said vertical post in proximity to the upper end thereof;

a first resistance means, engaged with said mount, for resisting the sliding motion of said mount along said slide platform in a predetermined manner;

a second resistance means, engaged with said pedal bars, for resisting the pivoting motion of said pedal bars in a predetermined manner;

whereby, a user, with hands grasping respective said handle bars and feet resting on said footrest, can exercise various parts of his or her body by repeatedly sliding said footrest and said mount to and fro along said slide platform; or by repeatedly rotating said footrest first in one direction and then in the other direction; or with feet resting against respective said pedal bars, by repeatedly stepping down on alternate said pedal bars in stair climbing fashion.

2. A floor mounted exercise machine according to claim 1 wherein:

a third resistance means is provided, engaged with said footrest, for resisting the rotational motion of said footrest in a pre-determined manner;

said third resistance means comprises at least one torsion spring engaged with said footrest and said mount.

3. A floor mounted exercise machine according to claim 1, wherein said first resistance means comprises a telescoping elastic member including:

a pair of elongate and slidingly engaged slide elements, with one end of a first said slide element pivotably secured to said base bar at a predetermined position thereon and the opposite end of a second said slide element pivotably secured to said mount;

a spring with one end thereof secured to a fixed position on the first said slide element and the other end thereof secured to a fixed position on the second said slide element.

4. An exercise machine according to claim 1, wherein said second resistance means comprises:

a viscous sliding brake disposed within said base bar and including a brake element slidingly secured on a central rod, with the ends of said central rod secured to fixed positions within said base bar;

a first pair of pulleys rotatably secured to respective lateral sides of said vertical post at predetermined positions thereon above the position of the rear ends of said pedal bars;

a second pair of pulleys rotatably secured to respective lateral sides of said vertical post at predetermined positions thereon below the position of the rear ends of said pedal bars;

a third pulley rotatably secured to a corresponding lateral side of said base bar;

a first cable, with one end thereof secured to a first said pedal bar at a predetermined position thereon, passing around a corresponding pulley of said first pair of pulleys, a corresponding pulley of said second pair of pulleys, and said third pulley, with the opposite end thereof secured to said brake element;

a second cable, with one end thereof secured to a second said pedal bar, passing around a corresponding pulley of said first pair of pulleys and a corresponding pulley of said second pair of pulleys, with the opposite end thereof secured to said brake element.

5. An exercise machine according to claim 3, wherein said second resistance means comprises:

a viscous sliding brake disposed within said base bar and including a brake element slidingly secured on a central rod, with the ends of said central rod secured to fixed positions within said base bar;

a first pair of pulleys rotatably secured to respective lateral sides of said vertical post at predetermined positions thereon above the position of the rear ends of said pedal bars;

a second pair of pulleys rotatably secured to respective lateral sides of said vertical post at predetermined positions thereon below the position of the rear ends of said pedal bars;

a third pulley rotatably secured to a corresponding lateral side of said base bar;

a first cable, with one end thereof secured to a first said pedal bar at a predetermined position thereon, passing around a corresponding pulley of said first pair of pulleys, a corresponding pulley of said second pair of pulleys, and said third pulley, with the opposite end thereof secured to said brake element;

a second cable, with one end thereof secured to a second said pedal bar, passing around a corresponding pulley of said first pair of pulleys and a corresponding pulley of said second pair of pulleys, with the opposite end thereof secured to said brake element.

6. An exercise machine according to claim 5, wherein each said pedal bar comprises a pivoting section with the rear end portion thereof pivotably secured to said vertical post and a folding section with the rear end portion thereof pivotably secured to the front end portion of said pivoting section, an end of a corresponding said cable being secured to said pivoting section on a predetermined position thereon.

7. An exercise machine according to claim 6, wherein:

an elongate slot is formed along said slide platform with the ends thereof in proximity to the respective ends of said slide platform;

a pair of elastic bumper elements are disposed within said slot at respective ends thereof;

a stop piece is secured under said mount and extends into said slot;

whereby, when a user slides said mount towards an end of said slide platform said bumper element abuts said stop piece and elastically deforms to prevent further motion of said mount along the traveled direction, without concomitant shock and noise.

8. An exercise machine according to claim 7, wherein said handle bars extend laterally outwards from an upper portion of said vertical post and descend towards respective lateral end portions of said slide platform, and secure thereto.

9. An exercise machine according to claim 8, wherein said footrest is releasably secured to said mount.

10. An exercise machine according to claim 9, wherein a securement appendage is formed at a predetermined position on said vertical post, on which said footrest can be releasably attached.

11. An exercise machine according to claim 8, wherein an electronic cycle and rate measuring system is provided that measures the rate and number of repetitions of a user's excercise motions when sliding said footrest and attached mount to and fro along said slide platform, pedaling up and down on said pedal bars, or rotating said footrest in one direction and then the other, said electronic cycle and rate measuring system comprising:

a microprocessor based controller disposed within an upper portion of said vertical post;

an electronic display, visibly disposed within an upper portion of said vertical post and controlled by said controller, displaying information including measured numbers of repetitions and rates of repetition of an exercise motion;

a set of control switches, disposed on an upper portion of said vertical post and in accessible positions thereon, controlling various functions of said controller;

a set of position sensors, disposed at predetermined positions on fixed members of said exercise machine, in electronic communication with said controller and conveying sensor data relating to the position of movable members of said exercise machine to said controller.

* * * * *